US012049705B2

(12) United States Patent
Umezawa

(10) Patent No.: US 12,049,705 B2
(45) Date of Patent: Jul. 30, 2024

(54) ELECTROFORMING METHOD AND METHOD FOR PRODUCING ELECTROFORMING MATERIAL

(71) Applicant: FUJIFILM CORPORATION, Tokyo (JP)

(72) Inventor: Tomokazu Umezawa, Kanagawa (JP)

(73) Assignee: FUJIFILM CORPORATION, Tokyo (JP)

( * ) Notice: Subject to any disclaimer, the term of this patent is extended or adjusted under 35 U.S.C. 154(b) by 0 days.

(21) Appl. No.: 17/930,719

(22) Filed: Sep. 9, 2022

(65) Prior Publication Data

US 2023/0101613 A1 Mar. 30, 2023

(30) Foreign Application Priority Data

Sep. 30, 2021 (JP) ..... 2021-162130

(51) Int. Cl.
*C25D 1/20* (2006.01)

(52) U.S. Cl.
CPC ..... *C25D 1/20* (2013.01)

(58) Field of Classification Search
None
See application file for complete search history.

(56) References Cited

U.S. PATENT DOCUMENTS 5,277,783 A * 1/1994 Ohashi ..... B41J 2/1625 205/75
2007/0012572 A1* 1/2007 Lee ..... C25D 1/10 205/67
2007/0134908 A1 6/2007 Banham et al.
(Continued)

FOREIGN PATENT DOCUMENTS

GB 1425628 A 2/1976
JP 2005-256110 A 9/2005
(Continued)

OTHER PUBLICATIONS

Vargas, Deisy & Jansen, H.V. & Elwenspoek, M.. (2005). Direct Electroplating on Highly Doped Patterned Silicon Wafers. (Year: 2005).*
(Continued)

*Primary Examiner* — Louis J Rufo
(74) *Attorney, Agent, or Firm* — SOLARIS Intellectual Property Group, PLLC

(57) ABSTRACT

An electroforming method capable of suppressing peeling of an electroforming material from an electroforming master during electroforming, and controlling a shape of an electroforming material, and a method for producing an electroforming material are provided. The present invention is to provide the electroforming method including forming an electroforming material on a surface of an electroforming master in an electroforming liquid by using the electroforming master as a cathode, in which the electroforming master includes a conductive substrate having a pattern on a surface, the pattern having a protruding portion of which a surface is non-conductive, and an underlying layer that has a sheet resistance of 500 Ω/sq or greater, and that is formed on at least a part of the surface of the substrate in an in-plane direction, and the method for producing an electroforming material.

14 Claims, 3 Drawing Sheets

(56) References Cited

U.S. PATENT DOCUMENTS

| | | | | |
|---|---|---|---|---|
| 2010/0215788 | A1* | 8/2010 | Kido | G11B 5/743 427/128 |
| 2012/0000885 | A1* | 1/2012 | Sakurai | C25D 1/10 216/22 |
| 2015/0004438 | A1 | 1/2015 | Takizawa et al. | |

FOREIGN PATENT DOCUMENTS

| | | | | |
|---|---|---|---|---|
| JP | 2007-287216 | A | 11/2007 | |
| JP | 2015-011746 | A | 1/2015 | |
| WO | 2013084429 | A1 | 6/2013 | |
| WO | WO-2013084429 | A1 * | 6/2013 | A61B 6/4291 |

OTHER PUBLICATIONS

Extended European Search Report dated Jan. 26, 2023, issued in corresponding EP Patent Application No. 22195735.0.

* cited by examiner

ELECTROFORMING METHOD AND METHOD FOR PRODUCING ELECTROFORMING MATERIAL

CROSS-REFERENCE TO RELATED APPLICATIONS

This application claims priority from Japanese Patent Application No. 2021-162130, filed Sep. 30, 2021, the disclosure of which is incorporated herein by reference in its entirety.

BACKGROUND OF THE INVENTION

1. Field of the Invention

The present disclosure relates to an electroforming method and a method for producing an electroforming material.

2. Description of the Related Art

An electroforming method is widely used as a method for producing parts having various shapes, dies, and the like. In the electroforming method, an electroforming master having a pattern on a surface thereof is used, and nickel or the like is electroformed on the electroforming master to produce an electroforming material.

Techniques related to the electroforming method are disclosed in, for example, JP2005-256110A, JP2007-287216A, and JP2015-011746.

SUMMARY OF THE INVENTION

For example, the electroforming material may peel off from the electroforming master during electroforming, and it may be necessary to control a shape of the electroforming material. Techniques related to the electroforming method, including the techniques disclosed in JP2005-256110A, JP2007-287216A, and JP2015-011746, have been studied in the related art, but currently, techniques for suppressing such peeling and controlling the shape have not been studied sufficiently.

The present disclosure has been made in view of such circumstances, and an objective to solve the problems by an embodiment of the present disclosure is to provide an electroforming method capable of suppressing peeling of an electroforming material from an electroforming master during electroforming, and controlling a shape of an electroforming material.

An objective to solve the problems by another embodiment of the present disclosure is to provide a method for producing an electroforming material by the electroforming method.

The present disclosure includes the following aspects.

<1> An electroforming method comprising a step of forming an electroforming material on a surface of an electroforming master in an electroforming liquid by using the electroforming master as a cathode, in which the electroforming master includes a conductive substrate having a pattern on a surface, the pattern having a protruding portion of which a surface is non-conductive, and an underlying layer that has a sheet resistance of 500 Ω/sq or greater, and that is formed on at least a part of the surface of the substrate in an in-plane direction.

<2> The electroforming method according to <1>, in which the conductive substrate contains a n-type semiconductor.

<3> The electroforming method according to <1> or <2>, in which an oxide film having a thickness of 2 Å to 50 Å is formed on the surface.

<4> The electroforming method according to any one of <1> to <3>, in which the underlying layer is formed on a region excluding the protruding portion.

<5> The electroforming method according to any one of <1> to <4>, in which a contact angle of the underlying layer with water at 23° C. is 45° or smaller.

<6> The electroforming method according to any one of <1> to <5>, in which the underlying layer is formed through vacuum film deposition.

<7> The electroforming method according to any one of <1> to <6>, in which a thickness of the underlying layer is 0.5 nm to 4 nm.

<8> The electroforming method according to any one of <1> to <5>, in which the underlying layer is a film formed by phase separation of a conductive material from a non-conductive material.

<9> The electroforming method according to any one of <1> to <8>, in which the underlying layer is a film having a discontinuous structure.

<10> The electroforming method according to any one of <1> to <9>, in which the underlying layer contains a metal.

<11> The electroforming method according to <10>, in which a metal precipitated from the electroforming liquid includes a same metal as the metal for forming the underlying layer.

<12> The electroforming method according to any one of <1> to <11>, in which the metal precipitated from the electroforming liquid contains nickel as a main component.

<13> A method for producing an electroforming material comprising:

a step of forming the electroforming material by the electroforming method according to any one of <1> to <12>; and a step of peeling the electroforming material from the electroforming master.

<14> The method for producing an electroforming material according to <13>, further comprising a step of washing the electroforming master after the step of peeling the electroforming material from the electroforming master, in which one or more cycles including the step of washing the electroforming master, the step of forming the electroforming material, and the step of peeling the electroforming material from the electroforming master are performed.

<15> The method for producing an electroforming material according to <14>, in which at least one cycle of the one or more cycles includes a step of forming the underlying layer, which is performed between the step of washing the electroforming master and the step of forming the electroforming material.

DESCRIPTION OF THE PREFERRED EMBODIMENTS

Figure 1:
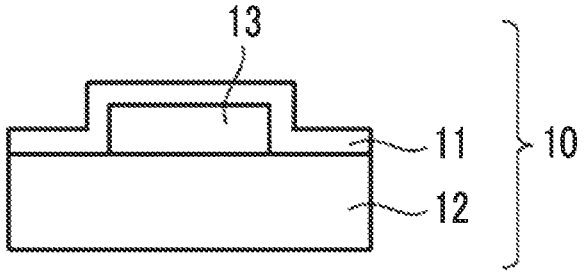
FIG. 1 is a schematic cross-sectional view illustrating an example of an electroforming master.

In the present disclosure, the numerical ranges expressed using "to" include the numerical values before and after the "to" as each of the minimum value and the maximum value.

In a range of numerical values described in stages in the present disclosure, the upper limit value or the lower limit value described in one range of numerical values may be replaced with an upper limit value or a lower limit value of the range of numerical values described in other stages. In addition, in a range of numerical values described in the present disclosure, the upper limit value or the lower limit value of the range of numerical values may be replaced with values illustrated in the examples.

In the present disclosure, in a case where a plurality of substances corresponding to components are present in a material, an amount of each component in the material means a total amount of the plurality of substances present in the material, unless otherwise noted.

In the present disclosure, a combination of two or more preferred aspects is the more preferred aspects.

In the present disclosure, the term "step" includes not only an independent step but also a step provided that the intended purpose of the step is achieved even in a case where the step cannot be clearly distinguished from other steps.

In the present disclosure, an "n-type semiconductor" refers to a semiconductor in which free electrons are used as carriers that carry charges.

Electroforming Method

An electroforming method according to the present disclosure includes

- a step of forming an electroforming material on a surface of an electroforming master in an electroforming liquid by using the electroforming master as a cathode,
- in which the electroforming master includes a conductive substrate having a pattern on a surface,
- the pattern having a protruding portion of which a surface is non-conductive, and
- an underlying layer that has a sheet resistance of 500 Ω/sq or greater, and that is formed on at least a part of the surface of the substrate in an in-plane direction.

Specifically, the surface of the electroforming master on which the electroforming material is formed is at a side of the conductive substrate at which the pattern is formed. For the purpose of controlling a shape of the electroforming material, a non-conductive pattern consisting of an insulating film may be provided on the surface of the electroforming master. The surface of the electroforming master is usually naturally oxidized to form an oxide film. For example, in a case where the electroforming master includes a substrate containing a silicon-based semiconductor, a film made of silicon oxide is formed in the above region. Since such an oxide film weakens the electrostatic attraction between the electroforming master and the electroforming material, the electroforming material may peel off from the electroforming master during electroforming.

By contrast, an electroforming master in which an underlying layer having a sheet resistance of 500 Ω/sq or greater is formed on at least a part of the surface of the substrate in the in-plane direction is used in the electroforming method according to the present disclosure. It is possible to ensure the adhesiveness between the electroforming master and the electroforming material in the region where the underlying layer is provided by using the underlying layer. According to this, it is possible to suppress the peeling of the electroforming material from the electroforming master during electroforming.

In addition, in-plane conductivity is low in the region where the underlying layer is provided. Therefore, the progress of electroforming can be suppressed. Furthermore, the progress of electroforming can also be suppressed by the pattern in which the surface of the protruding portion is non-conductive. Therefore, since portions of the electroforming material in which the progress of electroforming differs are generated, it is possible to control the shape of the electroforming material (for example, through-hole formation, unevenness formation, and the like).

Electroforming Master

The electroforming master includes

- a conductive substrate having a pattern on a surface,
- the pattern having a protruding portion of which a surface is non-conductive, and
- an underlying layer that has a sheet resistance of 500 Ω/sq or greater, and that is formed on at least a part of the surface of the substrate in the in-plane direction is formed.

The "surface of the substrate" on which the underlying layer is provided includes a pattern.

The protruding portion of the pattern may refer to the entire pattern that is provided on the surface of the substrate and protrudes from the substrate, or the protruding portion of the pattern in a case where the pattern has a portion protruding in a projection shape. In the latter case, the surface of only the protruding portion may be non-conductive, or the surface of the entire pattern including the protruding portion may be non-conductive.

As an example, as illustrated in FIG. 1, an electroforming master 10 includes a substrate having a pattern 13 on a surface of the substrate. In addition, an underlying layer 11 is formed on the substrate 12 in an in-plane direction of the entire surface including a surface of the protruding pattern 13 disposed on the surface of the substrate 12.

In the present disclosure, the term "conductive" means that a conductivity at 23° C. is 20 S/m or greater. The conductivity is a value calculated by using a resistance value measured by a four-probe method or the like. A conductivity of smaller than 20 S/m is referred to as "non-conductive".

The conductive substrate is not particularly limited as long as the conductivity at 23° C. is 20 S/m or greater, and may include, for example, a metal or a semiconductor. A metal that can be contained in the substrate is not particularly limited, and examples thereof include nickel, chromium, copper, iron, and the like.

The conductive substrate preferably contains a n-type semiconductor. The n-type semiconductor is not particularly limited, and known n-type semiconductors in the related art can be used. Examples of the n-type semiconductor include silicon compounds (silicon-based semiconductors), fullerene compounds, electron-deficient phthalocyanine compounds, condensed ring polycyclic compounds (such as naphthalenetetracarbonyl compounds and perylenetetracarbonyl compounds), and tetracyanoquinodimethane compounds (such as TCNQ compounds), polythiophene compounds, benzidine compounds, carbazole compounds, phenanthroline compounds, and the like.

Among the above-described examples, the n-type semiconductor is preferably a silicon-based semiconductor from the viewpoint of improving the adhesiveness to the electroforming material. Examples of the silicon-based semiconductor include single crystal silicon, polycrystalline silicon, amorphous silicon, polysilicon, and the like.

From the viewpoint of improving the adhesiveness to the electroforming material, a thickness of the conductive substrate is preferably 50 μm to 1,500 μm, more preferably 300 μm to 1,000 μm, and still more preferably 500 μm to 750 μm.

The pattern provided on the surface of the substrate is not particularly limited as long as the surface on the protruding portion of the pattern is non-conductive, and it is preferable to appropriately adjust the pattern according to the application of the produced electroforming material.

In an aspect, the pattern is preferably formed by an inorganic insulating film. Since the pattern is formed by the inorganic insulating film, electroforming of nickel or the like on the pattern can be suppressed. Therefore, for example, a portion of the electroforming material formed on the pattern can be thinned, or a through-hole can be formed in the portion of the electroforming material formed on the pattern, thereby capable of forming the electroforming material having a desired shape.

In the above described aspect, in a case where the pattern is formed of an inorganic insulating film, the inorganic insulating film is preferably a silicon-based oxide film. For example, the inorganic insulating film can be an inorganic insulating film formed of silane dioxide.

Since the inorganic insulating film is a silicon-based oxide film, electroforming of nickel or the like on the pattern can be further suppressed, and an electroforming material having a desired shape can be produced. In addition, since the inorganic insulating film is a silicon-based oxide film, the adhesiveness to the substrate can be improved. Furthermore, according to the electroforming master including the substrate with the above pattern, in a case where the formed electroforming material is peeled off from the electroforming master, it is possible to suppress that the pattern is also peeled off, so that regeneration of the pattern is not required. Therefore, the electroforming master including the substrate with the above pattern is suitable for continuous production of the electroforming material and is preferable.

As the silicon-based oxide film, an oxide-containing film of the above-described silicon-based semiconductor can be used.

In the above described aspect, a thickness of the inorganic insulating film is preferably 0.1 μm or greater, more preferably 0.5 μm or greater, and still more preferably 1 μm or greater from the viewpoint of suppressing electroforming of nickel or the like.

The upper limit of the thickness of the inorganic insulating film is not particularly limited, and may be, for example, 10 μm or smaller.

The thickness of the inorganic insulating film may be measured by the same method for measuring a thickness of the oxide film described later, or may be measured by a surface step profiler.

The underlying layer is formed on at least a part of the surface of the substrate in the in-plane direction, and a sheet resistance of the underlying layer is 500 Ω/sq or greater. Since the sheet resistance of the underlying layer is 500 Ω/sq or greater, the shape of the electroforming material can be controlled. The sheet resistance is a value measured by the four-probe method at 23° C. using a surface resistance meter. The underlying layer is formed on an insulating substrate (for example, quartz glass) under the same conditions as in the case of the underlying layer is formed on the surface of the substrate of the electroforming master, and a sheet resistance of the underlying layer that is formed on the insulating substrate is measured. The sheet resistance of the underlying layer formed on the insulating substrate is defined as a sheet resistance value of the underlying layer that is formed on the surface of the substrate of the electroforming master.

From the viewpoint of shape control of the electroforming material, the sheet resistance value of the underlying layer is preferably 500 Ω/sq or greater, and more preferably 1000 Ω/sq or greater.

The sheet resistance value of the underlying layer is preferably 10 MΩ/sq or smaller, more preferably 1 MΩ/sq or smaller, and still more preferably 5000 Ω/sq or smaller, from the viewpoint of not inhibiting the growth of the electroforming material.

A forming aspect of the underlying layer is not particularly limited as long as at least a part of the surface of the substrate is formed in the in-plane direction. For example, FIG. 1 is an example in which the underlying layer 11 is formed on the entire surface of a region excluding the protruding portion of the pattern in the in-plane direction (a region excluding the pattern 13 in FIG. 1).

In an aspect, the underlying layer may be formed in a region excluding the protruding portion of the pattern. That is, in an aspect, the underlying layer may be formed on the pattern, and the underlying layer is preferably not formed on the protruding portion of the pattern. Surfaces of the protruding portion on which the underlying layer is formed are preferably the top surface and the side surfaces of the protruding portion.

For example, the underlying layer may be a film having a discontinuous structure.

Whether or not the underlying layer has a discontinuous structure can be determined as follows by an observation of the underlying layer with a scanning electron microscope.

That is, it is determined that the underlying layer in a state in which particles are isolated, and adjacent particles are almost not overlapped with each other, that is, a state in which a so-called island-like structure is observed has a discontinuous structure.

The underlying layer is not particularly limited as long as the sheet resistance is 500 Ω/sq or greater, and the underlying layer is may be, for example, a layer made of a conductive material (for example, a metal), a layer containing a conductive material, a layer containing a non-conductive material (for example, an organic material such as a resin), or a layer containing a conductive material and a non-conductive material. The conductive material is preferably a metal, and the underlying layer preferably contains a metal.

A metal that can be contained in the underlying layer is not particularly limited, and examples thereof include nickel, chromium, copper, iron, and the like.

In a case where the underlying layer is a layer made of a metal, the underlying layer may be formed through vacuum film deposition.

When the underlying layer is a layer containing a conductive material and a non-conductive material, the underlying layer may be a film formed by phase separation of the conductive material from the non-conductive material. For example, a composition containing metal fine particles and a resin may be applied and dried to phase-separate the metal fine particles from the resin, thereby forming the underlying layer. The film formed by phase separation has an island-like structure, and phase separation is suitable for forming a film having a discontinuous structure.

For example, a phase-separating structure can also be formed using a composite target consisting of a metal such as Co and an oxide (insulator) such as $SiO_2$ by a sputtering method. In this case, a Co particle is surrounded by $SiO_2$, so that a film having a discontinuous structure can be formed.

The conductive material and the non-conductive material that can be contained in the underlying layer each may be one kind or two or more kinds.

The thickness of the underlying layer is not particularly limited, and may be appropriately set in consideration of a composition of the underlying layer, and the like.

The thickness of the underlying layer may be, for example, 0.5 nm to 4 nm, and is suitable as a thickness of a layer that is made of a metal and that is formed through vacuum film deposition. In a case where the underlying layer (layer made of a metal) is formed through vacuum film deposition, the underlying layer tends to have a continuous structure in a case where the thickness is 4 nm or greater, and to have a discontinuous structure in a case where the thickness is smaller than 4 nm (for example, 2 nm or smaller).

In the case where the underlying layer is formed through vacuum film deposition, the thickness of the underlying layer may be a value calculated based on film deposition conditions. The thickness of the underlying layer may be measured by an ellipsometer.

The thickness of the underlying layer may be, for example, 0.1 μm to 0.4 μm in a case where the composition containing the metal fine particles and the resin is applied and dried to form the underlying layer, or may be 5 nm to 30 nm in a case where the underlying layer is produced from the composite target consisting of a metal and an insulator by a sputtering method. Each of the above described thicknesses is suitable as a thickness of the film (a layer containing the conductive material and the non-conductive material) formed by phase separation of a conductive material from a non-conductive material. The thickness of the underlying layer may be a value calculated based on film deposition conditions.

An oxide film having a thickness of 2 Å to 50 Å may be formed on the surface of the substrate. Even in the presence of an oxide film having such thickness, the electrostatic attraction between the electroforming master and the electroforming material is secured. Therefore, it is possible to easily suppress peeling of the electroforming material from the electroforming master during electroforming.

The thickness of the oxide film is measured at 23° C.±2° C. and 50% RH±5% RH in an atmosphere by using an ellipsometer. As the ellipsometer, an automatic ellipsometer DVA-36L manufactured by Mizojiri Optical Co., Ltd. or a similar device can be used.

A contact angle of the underlying layer with water at 23° C. is preferably 45° or smaller, more preferably 40° or smaller, still more preferably 35° or smaller, and particularly preferably 30° C. or smaller.

By setting the contact angle of the underlying layer with water at 23° C. to 45° or smaller, it is possible to suppress the inclusion of the above-described air bubbles between the electroforming master and the electroforming material, and it is possible to suppress defects occurring by an increase in surface roughness of the electroforming material, which is caused by the air bubbles included.

In the present disclosure, the "contact angle of the underlying layer with water at 23° C." is measured by a method of dropping water in air with a water droplet volume of 1 μL using a contact angle meter.

As the contact angle meter, for example, DMo-701 manufactured by Kyowa Interface Science Co., Ltd. or a similar device can be used.

Method for Producing Electroforming Master

A method for producing the electroforming master is not particularly limited. For example, the electroforming master can be obtained by carrying out dry etching on the surface of the conductive substrate having a pattern on the surface, and the underlying layer is then formed by the above described vacuum film deposition, phase separation, or the like.

Conditions for forming the underlying layer by vacuum film deposition are not particularly limited, and known conditions may be used. In addition, by appropriately adjusting the conditions, it is possible to form the underlying layer that is a film having a discontinuous structure. As described above, for example, in a case where the underlying layer (layer made of a metal) is formed through vacuum film deposition, the underlying layer tends to have a continuous structure in a case where the thickness is 4 nm or greater, and to have a discontinuous structure in a case where the thickness is smaller than 4 nm (for example, 2 nm or smaller).

In addition, the conditions for forming the underlying layer by the phase separation are not particularly limited, and a formulation of the composition containing the conductive material and the non-conductive material, coating and drying conditions, and the like may be appropriately adjusted.

A method of performing dry etching on the surface of the substrate is not particularly limited, and the dry etching can be performed by using known etching gases in the related art.

The oxide film formed on the surface of the substrate in advance can be removed by dry etching the substrate.

For dry etching, it is preferable to use one or more gases selected from the group consisting of a rare gas, a fluorine-based gas, and a chlorine-based gas. By using the above gases, it is possible to prevent the oxide film from remaining on the surface of the substrate.

As the rare gas, He gas, Ar gas, and the like can be used.

As the fluorine-based gas, $SF_6$ gas, $CF_4$ gas, $CHF_3$ gas, $C_2F_6$ gas, $C_4F_8$ gas, and the like can be used.

As the chlorine-based gas, $Cl_2$ gas, $CHCl_3$ gas, $CH_2Cl_2$ gas, $CCl_4$ gas, $BCl_3$ gas, and the like can be used.

One or more treatments selected from the group consisting of treatment of immersion with sulfuric acid-hydrogen peroxide, an ultraviolet (UV) ozone treatment on the substrate, and an oxygen gas plasma treatment on the substrate may be carried out after the dry etching and before forming the underlying layer.

As a result of applying these treatments, organic substances remaining on the surface of the substrate can be removed, the adhesiveness of the electroforming material can be further enhanced, hydrophilicity can be enhanced, and the contact angle with water can be reduced.

As the substrate provided with a pattern on the surface of the electroforming master used for the production, a commercially available substrate may be used, or a substrate produced by a known method in the related art may be used.

Hereinafter, an embodiment of a method for producing a substrate provided with a pattern on a surface thereof will be described with reference to FIGS. 2A-2E.

Figure 2A:
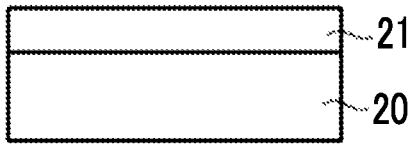
FIGS. 2A-2E are schematic cross-sectional views illustrating a flow of an example of a method for producing a substrate having a pattern on a surface.

First, a substrate 20 containing a silicon-based semiconductor is prepared, and one surface of the substrate 20 is thermally oxidized to form an inorganic insulating film 21 as a silicon-based oxide film (FIG. 2A).

Figure 2B:
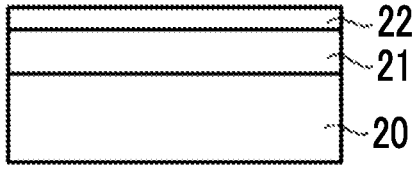

A resist is applied to the surface of the inorganic insulating film 21 to form a resist film 22 (FIG. 2B).

The resist is not particularly limited, and a photoresist that is used for photolithography in the related art can be used.

Figure 2C:
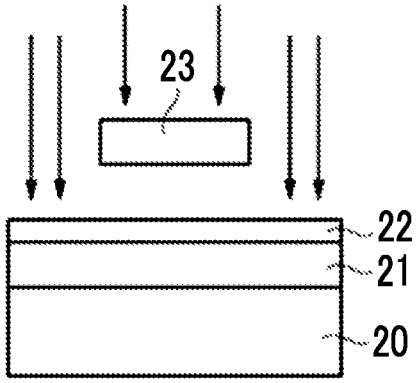

The resist film 22 is exposed in a patterned manner (FIG. 2C).

As illustrated in FIG. 2C, the exposure of the resist film 22 can be performed in a patterned manner by using a known patterning mask 23 in the related art.

Figure 2D:
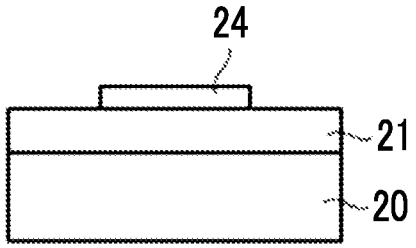

After the exposure, a known developer in the related art is used to remove an exposed portion of the resist film by washing to form a resist mask 24 (FIG. 2D).

Figure 2E:
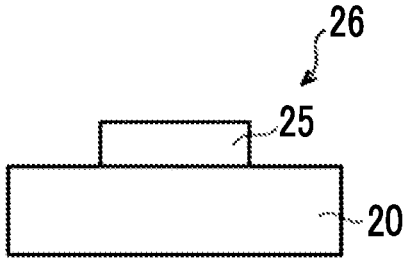

After the resist mask 24 is formed, the inorganic insulating film 21 formed in a portion where the resist mask 24 is not formed is removed by dry etching, and the resist mask 24 is then peeled off, thereby capable of obtaining a substrate 26 with a pattern (FIG. 2E).

Step of Forming Electroforming Material

The electroforming master is used as a cathode to form an electroforming material on the surface of the electroforming master in an electroforming liquid.

The electroforming liquid to be used is not particularly limited, and for example, nickel electroforming liquid can be used.

A material that can be used as an anode is not particularly limited, and for example, a nickel plate can be used.

The current density and energization time in the energization are not particularly limited, and it is preferable to appropriately adjust the current density and energization time according to a desired size of the electroforming material to be formed.

For example, the current density can be 5 $A/dm^2$ to 10 $A/dm^2$, and the energization time can be 10 minutes to 2 hours.

Figure 3:
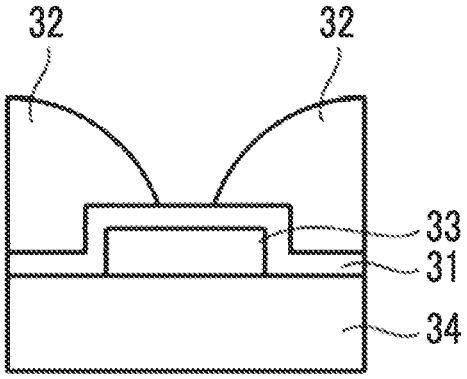
FIG. 3 is a schematic cross-sectional view illustrating an example of an electroforming master and an electroforming material formed on a surface of the electroforming master.

The electroforming material may be formed only on the surface of the oxide film, but for example, an electroforming material 32 grown on a surface of an underlying layer 31 on the substrate 34 may be formed to ride on a pattern 33 formed by an inorganic insulating film (so-called overgrowth), as illustrated in FIG. 3.

A metal precipitated from the electroforming liquid preferably includes the same metal as the metal constituting the underlying layer. According to this, it is easier to improve the adhesiveness between the electroforming material and the underlying layer.

The metal precipitated from the electroforming liquid differs depending on the electroforming liquid used, but for example, in a case where a nickel sulfamic acid electroforming liquid is used, nickel may be the main component. The fact that nickel is the main component means that a content of nickel is 70% by mass or more with respect to the total amount of the metal precipitated from the electroforming liquid.

Method for Producing Electroforming Material

A method for producing the electroforming material according to the present disclosure is as follows.

A step of forming an electroforming material by the electroforming method according to the present disclosure, and a step of peeling the electroforming material from the electroforming master are provided.

Step of Forming Electroforming Material

The step of forming an electroforming material is as described above in the electroforming method.

Step of Peeling Electroforming Material

A method for peeling the electroforming material from the electroforming master is not particularly limited, and a known method in the related art can be used.

Step of Washing Electroforming Master

A method for producing an electroforming material can include a step of washing the electroforming master after the step of peeling the electroforming material from the electroforming master. In this aspect, it is preferable to perform, in the method for producing an electroforming material, one or more cycles including the step of washing the electroforming master, the step of forming the electroforming material, and the step of peeling the electroforming material from the electroforming master. As a result, electroforming materials can be produced a plurality of times in succession without reproducing the electroforming master.

In an aspect, in the process of producing the electroforming material, at least a part of the underlying layer may be detached from the electroforming master. In this case, after washing the electroforming master and before forming the electroforming material, the underlying layer may be formed. That is, at least one cycle of one or more cycles may include a step of forming an underlying layer between a step of washing the electroforming master and a step of forming the electroforming material.

A method for washing the electroforming master is not particularly limited, and the electroforming master can be washed by a known method in the related art, and for example, the electroforming master can be washed by using a washing solution containing Caro's acid. Examples of the washing solution containing Caro's acid include SH303 manufactured by KANTO KAGAKU.

EXAMPLES

Hereinafter, the present disclosure will be described in more detail with reference to examples. However, the present disclosure is not limited to these examples.

Example 1

As described below, a substrate with a pattern was prepared through the same operation as the manufacturing process illustrated in FIGS. 2A-2E.

A substrate (thickness of 725 μm) containing a n-type silicon-based semiconductor was prepared, and one surface of the substrate was thermally oxidized to form an inorganic insulating film having a thickness of 2 μm. The inorganic insulating film was a silicon-based oxide film containing silane dioxide.

A resist (MICROPOSIT (registered trademark) S1818G, manufactured by ROHM AND HAAS ELECTRONIC MATERIALS K.K.) was applied to the surface of the inorganic insulating film by spin coating to form a resist film, and the resist film was exposed in a patterned manner. After the exposure, a developer was used to remove an unexposed portion of the resist film by washing to form a resist mask on the inorganic insulating film.

After forming the resist mask, the inorganic insulating film formed on a portion of the substrate where the resist mask was not formed was removed by a dry etching method using a mixed gas of $CHF_3$ and $CF_4$.

Next, the resist mask was peeled off to prepare a substrate in which a protruding pattern was provided on a surface of the substrate, the pattern (thickness: 2 μm) being formed by the inorganic insulating film. A thickness of the pattern was obtained by measuring a step of the protruding portion on the surface of the substrate with a surface step profiler.

The substrate having the pattern was left to stand in an environment of 23° C. and a humidity of 50% RH for 1 hour to form an oxide film having a thickness of 18 Å on the surface of the substrate. The thickness of the oxide film was measured by an ellipsometer (automatic ellipsometer DVA-36L manufactured by Mizojiri Optical Co., Ltd.) in the atmosphere at 23° C. and 50% RH.

An underlying layer (Ni sputtering film) was formed on the substrate having the pattern by using a direct current (DC) sputtering method under the following conditions.

Film deposition conditions:

Target: Ni

Ar gas flow rate: 13.8 sccm

Input power: 0.9 kW

As described above, the electroforming master in which the underlying layer having the thickness of 2 nm was formed on the entire surface of the substrate including the surface of the protruding portion of the pattern was prepared. The thickness of the underlying layer is a value calculated based on the above described film deposition conditions.

In a case where a sheet resistance of the underlying layer was measured by a four-probe method at 23° ° C. using a surface resistance meter "Lorester-GX" manufactured by Nittoseiko Analytech Co., Ltd., the sheet resistance was 1885 Ω/sq.

In a case of measuring the sheet resistance of the underlying layer, the underlying layer was formed on an insulating substrate (quartz glass) under the same conditions as in the case of the underlying layer is formed on the surface of the substrate of the electroforming master, and the sheet resistance of the underlying layer that is formed on the insulating substrate was measured. Then, the sheet resistance of the underlying layer formed on the insulating substrate was defined as a sheet resistance value of the underlying layer that was formed on the surface of the substrate of the electroforming master.

In a case of measuring a contact angle of the underlying layer with water at 23° C. by using a contact angle meter "DMo-701" manufactured by Kyowa Interface Science Co., Ltd., the contact angle was 27°. A water droplet volume was set to 1 μL and measured by a method of dropping water in air.

In a case where the underlying layer was observed with a scanning electron microscope "S-4800" manufactured by Hitachi High-Tech Corporation, particles were isolated and a state in which adjacent particles were almost not overlapped with each other, that is, a so-called island-like structure was seen, resulting in the underlying layer having a discontinuous structure.

Example 2

An electroforming master was produced in the same manner as in Example 1 except that a substrate having a pattern was immersed in sulfuric acid hydrogen peroxide before forming an underlying layer, the substrate was left to stand in an environment of 23° C. and a humidity of 50% RH for 18 hours, and an oxide film having a thickness of 25 Å was formed on the surface of the substrate. The underlying layer was observed in the same manner as in Example 1, and a sheet resistance and a contact angle were also measured in the same manner as in Example 1.

Examples 3 and 4

Electroforming masters were produced in the same manner as in Example 2, except that thicknesses of underlying layers were changed to those illustrated in Table 1. The underlying layer was observed in the same manner as in Example 1, and a sheet resistance and a contact angle were also measured in the same manner as in Example 1.

Example 5

An electroforming master was manufactured in the same manner as in Example 1 except that a substrate having a pattern was left to stand in an environment of 23° C. and a humidity of 70% RH for 192 hours, and an oxide film having a thickness of 50 Å was formed on the surface of the substrate. The underlying layer was observed in the same manner as in Example 1, and a sheet resistance and a contact angle were also measured in the same manner as in Example 1.

Example 6

An electroforming master was manufactured in the same manner as in Example 1 except that an underlying layer ($Ni/SiO_2$ phase separation sputtering film) was formed on a substrate having a pattern by using a radio frequency (RF) sputtering method under conditions described below. A sheet resistance and a contact angle were also measured in the same manner as in Example 1.

Film deposition conditions:

Target: $Ni/SiO_2$ target

Ar gas flow rate: 13.8 sccm

Input power: 0.5 kW

As described above, the electroforming master in which the underlying layer having a thickness of 6 nm was formed on the entire surface of the substrate including the surface of the protruding portion of the pattern was prepared. The thickness of the underlying layer is a value calculated based on the above described film deposition conditions.

Comparative Example 1

An electroforming master was manufactured in the same manner as in Example 1 except that a substrate containing a p-type silicon-based semiconductor was used instead of a substrate containing a n-type silicon-based semiconductor, and a thickness of an underlying layer was changed to that as illustrated in Table 1. A sheet resistance and a contact angle were also measured in the same manner as in Example 1.

Comparative Example 2

An electroforming master was produced in the same manner as in Example 1, except that a thickness of an underlying layer was changed to that illustrated in Table 1. The underlying layer was observed in the same manner as in Example 1, and a sheet resistance and a contact angle were also measured in the same manner as in Example 1.

Comparative Example 3

A substrate (thickness of 725 μm) containing a silicon-based semiconductor was prepared, a resist (MICROPOSIT (registered trademark) S1818G, manufactured by ROHM AND HAAS ELECTRONIC MATERIALS K.K.) was applied to the surface of the substrate by spin coating to form a resist film, and the resist film was exposed in a patterned manner. After the exposure, a developer was used to remove an unexposed portion of the resist film through washing, thereby forming a resist mask on the substrate.

After forming the resist mask, a portion of the substrate where the resist mask was not formed was etched by using a dry etching method in which a mixed gas of $CHF_3$ and $SF_6$ was used.

Next, the resist mask was peeled off to prepare a substrate having a pattern (thickness of 2 μm) formed by using the n-type silicon-based semiconductor. A thickness of the pattern was obtained by measuring a step of the protruding portion on the surface of the substrate with a surface step profiler.

In the same manner as in Example 1, an oxide film having a thickness of 18 Å was formed on a surface of a substrate having a pattern, and an underlying layer (Ni sputtering film) was then formed on the substrate having a pattern.

As described above, the electroforming master in which the underlying layer having a thickness of 2 nm was formed on the entire surface (that is, the entire surface of the region excluding the protruding portion of the pattern and the entire surface of the protruding portion of the pattern) of the substrate was prepared. The underlying layer was observed in the same manner as in Example 1, and a sheet resistance and a contact angle were also measured in the same manner as in Example 1.

Comparative Example 4

An electroforming master was produced in the same manner as in Example 1, except that an underlying layer was not formed. A sheet resistance and a contact angle were also measured in the same manner as in Example 1.

Evaluation of Peelability of Electroforming Material From Electroforming Master

The electroforming master produced in each of Examples and Comparative Examples was used as a cathode and immersed in a nickel sulfamic acid electroforming liquid, and energization was performed at a current density of 6.2 $A/dm^2$ for 50 minutes to electroform nickel on the surface of the electroforming master on which the oxide film was formed, thereby producing an electroforming material having a thickness of 50 μm. A nickel plate was used as an anode.

The current density was changed to 6.2 $A/dm^2$, and the energization time was changed to 10 minutes, thereby producing an electroforming material having a thickness of 10 μm in the same manner as described above.

The produced electroforming material was visually observed and evaluated based on the following evaluation standard. P1 and P2 are practical levels. The evaluation results are illustrated in Table 1.

(Evaluation Standard)

P1: Peeling of any of electroforming material having thickness of 50 μm and electroforming material having thickness of 10 μm from electroforming master was not confirmed.

P2: Peeling of electroforming material having thickness of 50 μm from electroforming master was confirmed, but no peeling of electroforming material having thickness of 10 μm from electroforming master was confirmed.

F: Peeling of both electroforming material having thickness of 50 μm and electroforming material having thickness of 10 μm was confirmed.

Evaluation of Shape Control

The electroforming material produced for the evaluation of the peelability of the electroforming material from the electroforming master was evaluated based on the results of observation on the patterned portion formed on the electroforming master according to the following evaluation standard. A and B are practical levels.

(Evaluation Standard)

A: Through-holes were formed in both electroforming material having thickness of 50 μm and electroforming material having thickness of 10 μm.

B: Through-hole was not formed in electroforming material having thickness of 50 μm, but through-hole was formed in electroforming material having thickness of 10 μm.

C: Through-holes were not formed in any of electroforming material having thickness of 50 μm and electroforming material having thickness of 10 μm Surface Roughness Ra Regarding an evaluation of peelability of the electroforming material from the electroforming master, the produced electroforming material was peeled off from the electroforming master, and a surface roughness Ra of a peeled surface of the electroforming material was measured by using a non-contact 3D surface roughness/shape measuring machine (New View 7300 manufactured by Zygo Corporation). The measurement results are illustrated in Table 1.

In Comparative Example in which peeling of the electroforming material from the electroforming master was confirmed during the production of the electroforming material, since the surface roughness Ra of the electroforming material was not measured, and the measurement results are described as "-" in Table 1.

TABLE 1

| | Substrate | Conductive carrier | Pattern | Thickness of oxide film [Å] | Electroforming master pretreatment | Thickness of underlying layer [nm] |
|---|---|---|---|---|---|---|
| Example 1 | n-type Si-based semiconductor | Electron | $SiO_2$ | 18 | None | 2 |
| Example 2 | n-type Si-based semiconductor | Electron | $SiO_2$ | 25 | Immersion with sulfuric acid-hydrogen peroxide | 2 |
| Example 3 | n-type Si-based semiconductor | Electron | $SiO_2$ | 25 | Immersion with sulfuric acid-hydrogen peroxide | 1 |
| Example 4 | n-type Si-based semiconductor | Electron | $SiO_2$ | 25 | Immersion with sulfuric acid-hydrogen peroxide | 0.5 |
| Example 5 | n-type Si-based semiconductor | Electron | $SiO_2$ | 50 | None | 2 |
| Example 6 | n-type Si-based semiconductor | Electron | $SiO_2$ | 18 | None | 6 |
| Comparative Example 1 | p-type Si-based semiconductor | Positive hole | $SiO_2$ | 18 | None | 4 |

TABLE 1-continued

| | | | | | | |
|---|---|---|---|---|---|---|
| Comparative Example 2 | n-type Si-based semiconductor | Electron | $SiO_2$ | 18 | None | 4 |
| Comparative Example 3 | n-type Si-based semiconductor | Electron | n-type Si | 18 | None | 2 |
| Comparative Example 4 | n-type Si-based semiconductor | Electron | $SiO_2$ | 18 | None | 0 |

| | Shape of underlying layer | Sheet resistance of underlying layer [Ω/□] | Contact angle of underlying layer [°] | Peeling during electroforming | Shape control | Surface roughness Ra [nm] |
|---|---|---|---|---|---|---|
| Example 1 | Discontinuous film (island-like) | 1885 | 27 | P2 | B | 0.7 |
| Example 2 | Discontinuous film (island-like) | 1885 | 27 | P1 | A | 0.7 |
| Example 3 | Discontinuous film (island-like) | 4500 | 31 | P1 | A | 0.6 |
| Example 4 | Discontinuous film (island-like) | 24000 | 31 | P2 | B | 0.6 |
| Example 5 | Discontinuous film (island-like) | 1885 | 27 | P2 | B | 2.0 |
| Example 6 | Discontinuous film (phase-separated) | 3400 | 40 | P2 | B | 3.0 |
| Comparative Example 1 | Continuous film | 231 | 85 | P1 | C | — |
| Comparative Example 2 | Continuous film | 231 | 85 | P1 | C | — |
| Comparative Example 3 | Discontinuous film (island-like) | 1885 | 27 | P1 | C | — |
| Comparative Example 4 | — | — | 30 | F | — | — |

As is clear from the results illustrated in Table 1, it was possible to suppress peeling of the electroforming material from the electroforming master during electroforming, and furthermore, it was possible to control the shape by using the electroforming master of the example, in which the underlying layer having a sheet resistance of 500 Ω/sq or greater was formed on at least a part of the surface of the substrate in the in-plane direction.

Since the contact angle of the underlying layer of each electroforming master of Examples with water at 23° C. was 45° or smaller, the surface roughness Ra of the electroforming material was as small as 2.0 nm or smaller.

Further, by using the electroforming master of the example, the through-hole was formed in at least one of the electroforming material having a thickness of 50 μm or the electroforming material having a thickness of 10 μm.

By contrast, in Comparative Examples 1 and 2, since the sheet resistance of the underlying layer is as low as 231 Ω/sq, through-holes were not formed in any of the electroforming material having a thickness of 50 μm and the electroforming material having a thickness of 10 μm, and the shape control was not achieved.

In Comparative Example 3, since the substrate had the pattern on the n-type silicon-based semiconductor rather than the non-conductive pattern, through-holes were not formed in any of the electroforming material having a thickness of 50 μm and the electroforming material having a thickness of 10 μm, and the shape control was not achieved.

In Comparative Example 4, since the underlying layer was not formed, the electroforming material was peeled off during electroforming.

Evaluation of Suitability for Repeated Use

Here, the suitability for repeated use of the electroforming master in each of Examples was evaluated by the following method.

First, the electroforming material produced for the evaluation of the peelability of the electroforming material from the electroforming master was peeled off from the electroforming master in each of Examples 1 to 6, and the electroforming master was washed with SH303 manufactured by KANTO KAGAKU.

After washing, the underlying layer was formed on the electroforming master by using the above-described method, and nickel was electroformed to produce an electroforming material. That is, the step of forming the underlying layer was carried out between the step of washing the electroforming master and the step of forming the electroforming material.

The step of washing the electroforming master, the step of forming the underlying layer, the step of forming the electroforming material, and the step of peeling the electroforming material from the electroforming master were set as one cycle, and the cycle was repeated for 5 cycles.

After the electroforming material was peeled off, a pattern on the surface of the substrate included in the electroforming master in each of Examples was visually observed, and it was confirmed that no pattern was peeled off, and it was confirmed that repeated use can be achieved.

In addition, as a result of performing the evaluation of the adhesiveness between the electroforming master and the electroforming material on the electroforming material produced in each cycle, it was also confirmed that the evaluation results in Examples were the same as each other, and the adhesiveness to the electroforming material was not deteriorated even using multiple times.

EXPLANATION OF REFERENCES

10: Electroforming master
11: Underlying layer
12: Substrate
13: Pattern
20: Substrate
21: Inorganic insulating film
22: Resist film
23: Patterning mask
24: Resist mask
25: Pattern
26: Substrate with pattern
31: Underlying layer
32: Electroforming material
33: Pattern
34: Substrate

What is claimed is:

1. An electroforming method comprising
forming an electroforming material on a surface of an electroforming master in an electroforming liquid by using the electroforming master as a cathode,
wherein the electroforming master includes:
a conductive substrate having a pattern on a surface, the pattern having a protruding portion of which a surface is non-conductive, and
an underlying layer that has a sheet resistance of 500 Ω/sq or greater, and that is formed on at least a part of the surface of the substrate in an in-plane direction, and
wherein a contact angle of the underlying layer with water at 23° C. is 45° or smaller.

2. The electroforming method according to claim 1,
wherein the conductive substrate contains a n-type semiconductor.

3. The electroforming method according to claim 1,
wherein an oxide film having a thickness of 2 Å to 50 Å is formed on the surface.

4. The electroforming method according to claim 1,
wherein the underlying layer is formed on a region excluding the protruding portion.

5. The electroforming method according to claim 1,
wherein the underlying layer is formed through vacuum film deposition.

6. The electroforming method according to claim 1,
wherein a thickness of the underlying layer is 0.5 nm to 4 nm.

7. The electroforming method according to claim 1,
wherein the underlying layer is a film formed by phase separation of a conductive material from a non-conductive material.

8. The electroforming method according to claim 1,
wherein the underlying layer is a film having a discontinuous structure.

9. The electroforming method according to claim 1,
wherein the underlying layer contains a metal.

10. The electroforming method according to claim 9,
wherein a metal precipitated from the electroforming liquid includes a same metal as the metal for forming the underlying layer.

11. The electroforming method according to claim 1,
wherein the metal precipitated from the electroforming liquid contains nickel as a main component.

12. A method for producing an electroforming material comprising:
forming the electroforming material by the electroforming method according to claim 1; and
peeling the electroforming material from the electroforming master.

13. The method for producing an electroforming material according to claim 12, further comprising
washing the electroforming master after peeling the electroforming material from the electroforming master,
wherein one or more cycles including the washing of the electroforming master, the forming of the electroforming material, and the peeling of the electroforming material from the electroforming master are performed.

14. The method for producing an electroforming material according to claim 13,
wherein at least one cycle of the one or more cycles includes forming the underlying layer, which is performed between the washing of the electroforming master and the forming of the electroforming material.

* * * * *